United States Patent [19]

Cholet

[11] 4,426,950

[45] Jan. 24, 1984

[54] SUPPORTING SYSTEM FOR APPARATUSES DESTINED TO BE MOVED UNDER WATER

[75] Inventor: Jacques Cholet, L'Etang-la-Ville, France

[73] Assignee: Institut Francais du Petrole, Rueil-Malmaison, France

[21] Appl. No.: 272,241

[22] Filed: Jun. 10, 1981

Related U.S. Application Data

[63] Continuation of Ser. No. 23,979, Mar. 26, 1979, abandoned.

[30] Foreign Application Priority Data

Mar. 24, 1978 [FR] France ..... 78 09196

[51] Int. Cl.[3] ..... B63G 8/14

[52] U.S. Cl. ..... 114/245

[58] Field of Search ..... 114/244, 245, 275, 277, 114/280, 283, 312, 331, 332; 367/106, 130

[56] References Cited

U.S. PATENT DOCUMENTS

| | | | |
|---|---|---|---|
| 3,331,050 | 7/1967 | Kilmer et al. | 367/130 |
| 3,673,556 | 6/1972 | Biggs | 114/245 |
| 4,019,453 | 4/1977 | Bosswell et al. | 114/245 |
| 4,047,592 | 9/1977 | Sieber et al. | 367/106 |

*Primary Examiner*—Trygve M. Blix
*Assistant Examiner*—Jesús D. Sotelo
*Attorney, Agent, or Firm*—Millen & White

[57] ABSTRACT

A supporting system for carrying apparatuses to be moved under water at a substantially constant submersion depth, when towed from a ship, including a platform made up of two elongate members interconnected through plates carrying the apparatuses, a depth regulating paddle foil or flap, automatically controlled by the variation of the hydrostatic pressure, and a float secured to the platform, through cross members, at a certain distance above the platform.

18 Claims, 5 Drawing Figures

SUPPORTING SYSTEM FOR APPARATUSES DESTINED TO BE MOVED UNDER WATER

This is a continuation of application Ser. No. 23,979, filed Mar. 26, 1979, which is now abandoned.

BACKGROUND OF THE INVENTION

This invention relates to a submersible system for supporting apparatuses destined to be moved under water at a substantially constant depth.

More particularly, the invention concerns a system for moving within a water body elements such as apparatuses for oceanography surveys which are displaced at a determined submersion depth level when towed from a ship. Apparatuses adapted for seismic prospecting or for surveying the water bottom, such as seismic wave transmission sources, reception devices, sonars and echo-sounders, may for example be moved under water by the device according to the invention.

The prior art devices in this field may be illustrated by a device comprising two hulls of positive buoyancy interconnected through a central profiled platform which supports a seismic wave transmission source and through two cross-members, at least one of which, the front cross-member, includes a movable submersion paddle. The latter is monitored through a control system having the object of stabilizing the device substantially at a predetermined depth level. The transmission source is hydraulically actuated from a towing ship through an electrovalve system. Several devices may be simultaneously towed.

SUMMARY OF THE INVENTION

The system according to the invention, like the prior art device, is well adapted to carry and/or to maintain at a determined depth level a large number of oceanography apparatuses, but in addition, its strongly built structure is particularly well adapted to the transportation under water of a powerful seismic sources.

The device according to the invention comprises at least a supporting device including a movable submersion control paddle whose orientation is monitored through control means responsive to the variations of the submersion depth. The paddle in the context of this invention can just as well be defined as a foil or flap, but as will be seen, it functions to elevate or lower the entire device.

The device is characterized by the fact that the supporting device comprises the combination of a rigid support consisting of a plate laterally secured to two longitudinally extending elongated members, the movable paddle being arranged between the elongated members and at the head of the support and an elongated floating element maintained at a certain distance above the support through fastening means.

The support, being entirely rigid, is capable of satisfactorily withstanding the stresses imparted thereto by the operation, in particular, of a seismic source. The floating element being more removed from the one or more seismic sources is accordingly, more resistant to their effect. Moreover, this arrangement has the advantage of further lowering the center of gravity with respect to the center of buoyancy and accordingly, to further increase the stability of the device.

The system may comprise a succession of several supporting devices connected to one another through flexible traction cables and through a multi-channel line fed from the ship with fluid at a predetermined pressure. This line comprises spaced connectors adapted to be each connected to a corresponding connector of each supporting device. The interconnection means are so arranged as to facilitate the combined use of a certain number of supporting devices.

In addition the fastening means may comprise a system whereby the floating element can be laterally displaced with respect to the support. This arrangement facilitates access to the apparatuses carried by the support and the operations of immersing and raising on board the device, particularly when it forms a part of an assembly, as further described below.

BRIEF DESCRIPTION OF THE DRAWINGS

Other features and advantages of the invention will be better understood from the following description of a particular non-limitative embodiment of the device given with reference to the accompanying drawings wherein.

DETAILED DESCRIPTION OF THE PREFERRED EMBODIMENTS

Figure 1:
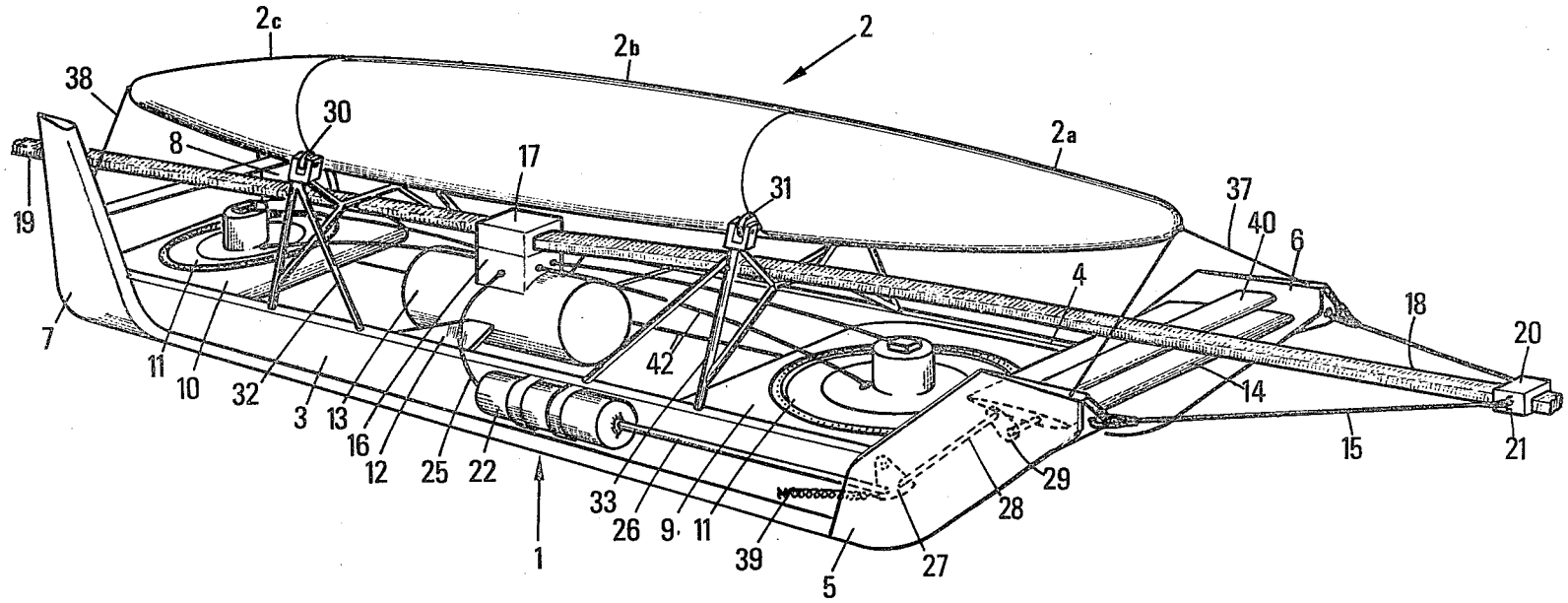
FIG. 1 is a perspective view of the supporting device.

The device comprises essentially a rigid frame or platform 1 of negative buoyancy suspended from a floating element or float 2. The rigid frame comprises two longitudinal elongate members 3 and 4; each of which is secured, at a first end, to an inclined first plate 5 and 6 forming the stem and, at a second end, to a second plate 7 and 8 forming the directional leeboard. The two longitudinal elongate members 3 and 4 are rigidly connected to each other through crossmembers consisting for example of two profiled plates 9 and 10, each provided with a housing for an oceanography apparatus such as a seismic wave source 11. The two longitudinal elongate members may also be connected through a third plate 12 supporting other oceanography apparatuses. In the present case, the third plate supports an enclosure or caisson 13 containing an assembly of control members consisting for example of the hydraulic and electric apparatuses required for the operation of the two seismic sources 11. The first plates 5 and 6, forming the stem, are provided with housings for the rotation axis of a movable flap 14. The two plates 5 and 6 are further interconnected through a cross-piece 40, also profiled. Preferably, the movable flap 14 is arranged above the plane determined by the two longitudinal elongate members 3 and 4. The first plates 5 and 6 also comprise fastening points for two towing cables 15. The enclosure 13 comprises a connecting member or connector 16 on which is adapted a corresponding connecting plug 17. To the plug 17 are connected two sheathed multi-channel flexible cables 18 and 19. Cable 18 comprises an intermediate member 20 provided with anchoring points 21 for the towing cables 15. Cable 18 is connected, in case of a single device or at the head of a train or similar devices, to a towing ship, not shown.

When the device is preceded by another similar device, cable 18 is connected to plug 17 of the preceding device.

To the connecting member 16 are also connected hydraulic and/or electric cables 42 for feeding the transported apparatuses.

Figure 3:
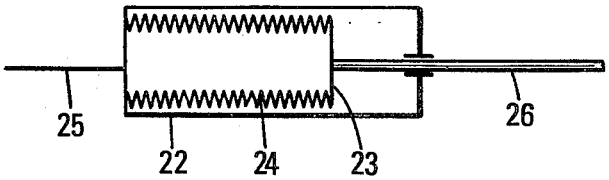
FIG. 3 is a diagrammatic view of an embodiment of an element of the control system responsive to the hydrostatic pressure variations.

Control means are secured to the longitudinal elongate member 3 for example. It comprises a cylinder 22 wherein a movable element is displaceable in response to variations of the pressure difference between the hydrostatic pressure and a counter-pressure prevailing into the cylinder. This movable member consists, for example, (FIG. 3) of a movable wall 23 of a bellows 24 arranged in the cylinder and secured, at one of its ends, to the internal wall thereof. The bellows 24 is adapted to expand or retract mainly in the direction of the cylinder axis. The interior of the bellows communicates through a line 25 (FIG. 1) with the connector 16 and, through the latter, with a fluid source of adjustable pressure located on the towing ship. The movable wall 23 of the bellows is also subjected to the hydrostatic pressure. An assembly of rods and levers is adapted to convert the linear motion of the movable wall 23 to a pivoting movement imparted to the movable flap 14. This assembly comprises a rod 26 secured to the movable wall 23 of the bellows and a first lever 27 adapted to rotate with respect to the elongated member 3 in response to the motion of rod 26. A second rod 28 is secured to the first lever 27 on the one hand and to a second lever 29 secured to the rotation axis of the movable flap 14, on the other hand. A return spring 39 is fastened, for example, to the rigid frame 1 by a first end and to the lever 27 by a second end. It exerts a repelling force resulting in the upward inclination of the movable flap 14.

The relative location of the parts forming the control system and their sizes are selected so that, when the device is moving under water at a depth corresponding to the counter-pressure applied into the bellows 24, the movable flap is in neutral position. When the device ascends above this depth, the bellows 24 expands and its motion, transmitted through an assembly of rods and levers, imparts to the movable flap a downward inclination, thereby resulting in a lowering of the device. On the other hand, when the device descends below the reference depth, the bellows 24 retracts and its motion, transmitted to the movable flap 14, results in an upward inclination of the latter, whereby the device re-ascends. By a modification, which can be controlled from the towing ship, of the counter-pressure applied into the bellows, it is possible to change at will the submersion depth at which the device or the assembly of devices is moving.

The control means may comprise several cylinders coupled through assemblies of rods and levers to the movable flap, in order to increase the efficiency of the depth control. It is also possible to replace the above-mentioned control means by an electrically actuated control system.

The device further comprises means for fastening the platform 1 to the floating element 2 which consists, for example, of a single float of elongate shape. The fastening means comprises two coupling bars 30 and 31 secured to the float respectively at its front and its rear parts. The two coupling bars 30 and 31 bear, at their respective end, respectively on two rigid frames 32 and 33, secured to platform 1 and consisting, for example, of a tubular assembly.

Figure 2:
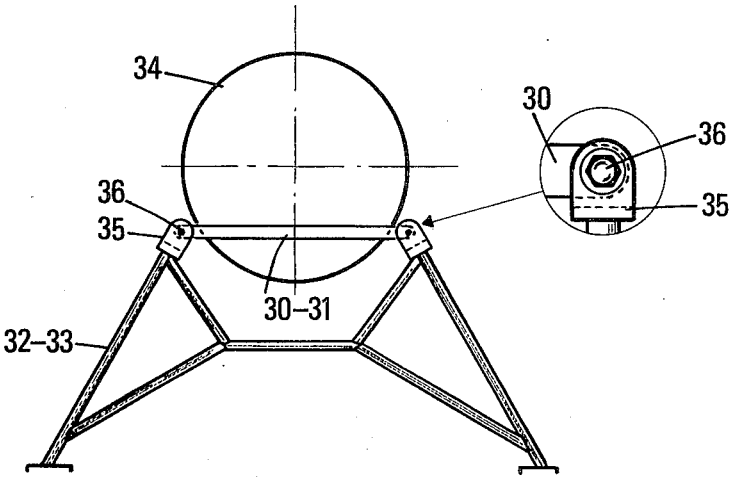
FIG. 2 is a view of a supporting frame of the floating element.

Each coupling bar is secured to a fixing plate 34 (FIG. 2). The floating element is made of three parts. The median part **2*b* is connected to the front part 2*a* and to the rear part 2*c* through fixing plates 34. The ends of each coupling bar 30 and 31 fit into two female members or fork-joints 35 secured to the upper part of each rigid frame 32 and 33. Assembling pins or rods crossing each fork-joint are used to fasten the float 2 to the rigid frames at four fastening points. When the two assembling pins on the same side of the floating element are removed, the latter can pivot with respect to the rigid frames about the two remaining assembling pins 36**.

Finally, flexible cables 37 and 38 are secured to the head on the rear parts of the float 2 and respectively to the inclined plates 5 and 6 forming the stem and to further plates 7 and 8 forming the directional leeboards.

At rest, in water, the buoyancy of the device is positive.

The flexible multi-channel lines 18 and 19 are stored on reels on the ship. When immersing a device or assembly of devices, the following operations are performed:

The two assembling pins 36, securing the coupling bars 30 and 31 on a single side of element 2, are disengaged, the flexible cables 37 and 38 are disconnected and the floating member is rotated with respect to platform 1;

The multi-channel line is unwound from the reel and the connector 17 is connected to the corresponding connector 16 of the caisson 13 of the device;

The float 2 is reset to its initial position on the two rigid frames, the flexible cables 37 and 38 joining the float to the support are fixed in position and the towing cables are connected to an intermediate fastening member 20 of the multi-channel line 18.

The device is then ready to be immersed. When a train of such devices must be used, the preceding operations are renewed with the following devices by unwinding the multi-channel line from its storage reel and by connecting the connectors 17 and the towing cables to other connectors 16 and to other intermediate members arranged at regular intervals along said multi-channel line.

When the assembly of devices is immersed, the bellows of all the control systems are fed with a fluid at a reference pressure corresponding to the desired submersion depth, thereby producing a downward inclination of the flaps and the lowering of the device as soon as the towing operation begins.

At the end of the operation period, the multi-channel line is wound onto the storage reel. The devices are hoisted on board the ship successively. By pivoting each float 2 with respect to the corresponding rigid frame 32 and 33, the multi-channel lines 18 and 19 are disengaged from their fastening points to the platform and they are wound on the storage reel.

Figure 4:
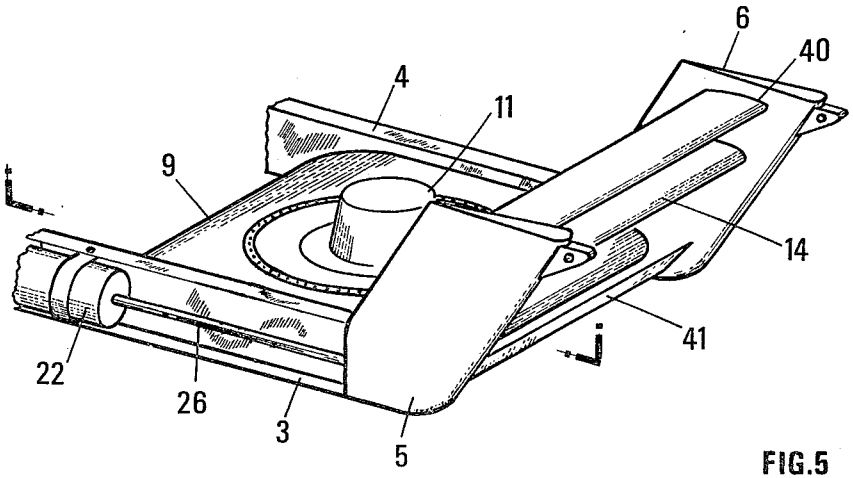
FIG. 4 is a partial view of the front portion of the support device alone, according to an alternative embodiment of the device of FIG. 1.
Figure 5:
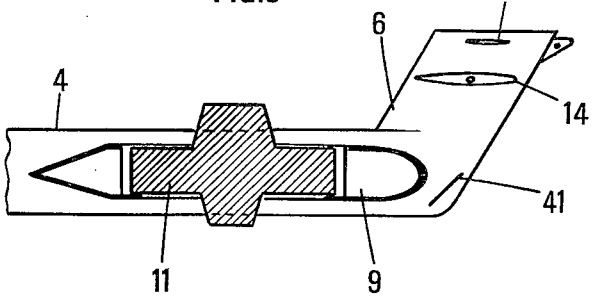
FIG. 5 is a partial view in longitudinal cross-section of the embodiment of FIG. 4.

The alternative embodiment shown in FIGS. 4 and 5, wherein the float is not shown, further comprises an additional flaps 41, extending slightly beyond the profiled plate 9 and rearwardly inclined. This flap 41 has the effect of orienting the water stream passing under the profiled plate 9 thereby improving the stability of the device. In addition, it may facilitate the depth control of the device.

What I claim is:

1. A system for carrying apparatuses to be displaced under water at a substantially constant submersion depth when towed from a ship, comprising at least one supporting device provided with a movable flap whose orientation is monitored by control means responsive to variations in submersion depth for controlling the submersion of the supporting device, each supporting device comprising the combination of a rigid support adapted for carrying said apparatuses thereon and comprising at least two plates laterally fastened to two longitudinal elongate members, an apparatus of said apparatuses carried by a first plate of said rigid support and a control assembly of said apparatus carried by a second plate thereof, the movable flap being arranged between the two elongate members and at the head of the support, and an elongate floating element, having a positive buoyancy at least sufficient to be maintained at the surface when not in use, maintained at a certain distance above the support through fastening means for carrying said rigid support underwater.

2. A system according to claim 1, wherein said apparatuses comprise at least one seismic wave transmission source.

3. A system according to claim 2, wherein said control assembly is arranged in a caisson and is connected to the ship through a detachable tight connection system.

4. A system to claim 3, wherein said connection system comprises at least one feeding pipe of pressurized fluid and electric cables joined together in a single flexible multi-channel line.

5. A system according to claim 1, wherein said rigid support comprises a flap for orienting the water stream passing under said plates.

6. A system according to claim 1, wherein said control means comprises electronically actuated means.

7. A system for carrying apparatuses destined to be displaced under water at a substantially constant submersion depth when towed from a ship, comprising a successive plurality of several supporting devices, each provided with a movable flap whose orientation is monitored by control means responsive to the variations of the submersion depth for controlling the submersion of each supporting device, each supporting device comprising the combination of a rigid support adapted for carrying said apparatuses thereon and comprising at least two plates laterally fastened to two longitudinal elongate members, an apparatus of said apparatuses carried by a first plate of said rigid support and a control assembly of said apparatus carried by a second plate thereof, the movable flap being arranged between the two elongate members and at the head of the support, and an elongate floating element, having a positive buoyancy at least sufficient to be maintained at the surface when not in use, maintained at a certain distance above the support through fastening means for carrying said support underwater, said supporting devices being connected to one another through traction flexible cables and through a multi-channel line fed from the ship with a fluid at a predetermined pressure, said line comprising spaced connectors adapted to be each connected to a corresponding connector of each supporting device.

8. A system according to claim 7, wherein said control means comprises at least one cylinder, an element translationally movable with respect to said cylinder and displaced in response to the variations of the pressure difference between the hydrostatic pressure and a counter-pressure prevailing in said cylinder, and a conversion system for converting the translational movement of said movable element to a rotational movement imparted to said movable flap.

9. A system according to claim 8, wherein said system for converting said translational movement to a rotational movement comprises an assembly of rods and levers.

10. A system according to claim 9, wherein said multi-channel line comprises an intermediate member for coupling on towing cables secured to said rigid support.

11. A system according to claim 8, comprising a return spring having one end secured to said support and the other end connected to said conversion system.

12. A system according to claim 8, wherein said movable element comprises a bellows filled with a pressurized fluid at a pressure substantially balancing the hydrostatic pressure at said selected submersion depth, the bellows being secured by a first end to said cylinder and by the other end to said conversion system.

13. A system according to claim 7, wherein said multi-channel line comprises an intermediate member to couple on towing cables secured to the rigid support.

14. A system according to claim 7, wherein said apparatuses carried by each supporting device consist of at least one seismic wave transmission source, said control assemblies being connected to said ship through the multi-channel line.

15. A system for carrying apparatuses destined to be displaced under water at a substantially constant submersion depth when towed from a ship, comprising a series of several supporting devices, each provided with a movable flap whose orientation is monitored by control means responsive to the variations of the submersion depth for controlling the submersion of each supporting device, each supporting device comprising the combination of a rigid support adapted for carrying said apparatuses thereon and comprising at least two plates laterally secured to two longitudinal elongate elements, an apparatus of said apparatuses carried by a first plate of said rigid support and a control assembly of said apparatus carried by a second plate thereof, the movable flap being arranged between the two elongate elements and at the head of the support, and an elongate floating element, having a positive buoyancy at least sufficient to be maintained at the surface when not in use, maintained at a certain distance above the support through securing means for carrying said support underwater, the supporting devices being connected to one another through traction flexible cables and through a multi-channel line fed from the ship with a fluid at a predetermined pressure, said line comprising spaced connectors adapted to be each connected to a corresponding connector of each supporting device, and said securing means comprising a system whereby the floating element can be laterally displaced, with respect to the support so as to clear the upper portion of the support when establishing the connection between the connector of the multi-channel line and the connector of the supporting device.

16. A system according to claim 15, wherein said floating element is fastened to two coupling bars each respectively secured to the head portion and to the rear portion of said floating element and said securing means comprises two rigid frames, each one of which has bearing points for said coupling bars, at least one of said bearing points of each bar being a pivot point for rotation of said floating element with respect to said rigid support.

17. A system according to claim 16, wherein said securing means also comprises elements secured, on the one hand, to the floating element and, on the other hand, to the lateral elongate members.

18. A system according to claim 16, wherein said securing means also comprises elements secured, on the one hand, to the floating element and, on the other hand, to the rigid support.

* * * * *